United States Patent [19]

Herbort et al.

[11] Patent Number: 4,466,814

[45] Date of Patent: Aug. 21, 1984

[54] PROCESS AND APPARATUS FOR CONDITIONING SALIFEROUS ATMOSPHERIC INTAKE AIR

[75] Inventors: Hans-Joachim Herbort; Heinz G. Schuster, both of Dortmund, Fed. Rep. of Germany

[73] Assignee: UHDE GmbH, Dortmund, Fed. Rep. of Germany

[21] Appl. No.: 439,317

[22] Filed: Nov. 4, 1982

[30] Foreign Application Priority Data

Nov. 14, 1981 [DE] Fed. Rep. of Germany ..... 3145291

[51] Int. Cl.[3] ..... B01D 47/06

[52] U.S. Cl. ..... 55/90; 55/80; 55/92; 55/222; 55/238; 55/257 HE; 55/263; 261/115

[58] Field of Search ..... 55/23, 80, 90, 92, 222, 55/238, 257 R, 257 HE, 263, 385 R, 461, 84; 261/79 A, 115, 152, DIG. 3, DIG. 15, DIG. 43, DIG. 76

[56] References Cited

U.S. PATENT DOCUMENTS

| | | | |
|---|---|---|---|
| 1,101,902 | 6/1914 | Braemer | 261/DIG. 3 |
| 1,673,732 | 6/1928 | Brooks | 261/115 |
| 2,553,121 | 5/1951 | Touton | 261/152 |
| 2,694,042 | 11/1954 | Tadleshay et al. | 261/115 |
| 3,265,122 | 8/1966 | Ostrander | 261/115 |
| 3,334,471 | 8/1967 | Herron | 261/115 |
| 4,058,378 | 11/1977 | Saxton | 55/257 R |
| 4,227,893 | 10/1980 | Shaddock | 55/418 |

*Primary Examiner*—David L. Lacey

*Attorney, Agent, or Firm*—Fraser, Barker, Purdue & Clemens

[57] ABSTRACT

A process and apparatus for conditioning atmospheric sea air for subsequent use as process air in floating chemical processing plants. A stream of atmospheric sea air, is injected with a salt-free aqueous spray for dissolving salt particles contained therein. The excess water is then removed by passing the over saturated air stream through a drop separator. The residual intake air is then heated to reduce the relative humidity of the air prior to its passing through a blower.

5 Claims, 1 Drawing Figure

PROCESS AND APPARATUS FOR CONDITIONING SALIFEROUS ATMOSPHERIC INTAKE AIR

BACKGROUND OF THE INVENTION

This invention generally relates to conditioning of atmospheric air and, particularly to a process and apparatus for conditioning atmospheric sea air for use in floating chemical processing plants.

Employing chemical processing plants on floating platforms at off-shore natural gas and oil fields for processing raw gas and oil materials into semi-finished and/or finished products, has created numerous problems. One problem is that the intake air must be taken from the immediate vicinity of the floating platform because an extremely high intake stack unfavorably influences the stability of the floating platform. Another problem is that the salt content of sea air is relatively high and air temperatures of less than 0° C. are frequently encountered during winter seasons.

Although purification of atmospheric sea air in wash towers or in separation and filter plants has been successfully employed in the past, such processes have large space requirements and result in considerable pressure losses on the intake side of the plants.

SUMMARY OF THE INVENTION

The object of the present invention is to provide a process and apparatus for conditioning atmospheric sea air for subsequent use as process air in chemical processing plants.

The process according to the invention involves charging a flowing stream of atmospheric sea air with finely distributed salt-free water, freeing the flowing air stream of water drops and heating the air stream for reducing the relative humidity thereof; while the apparatus comprises a passageway defined by an annular suction pipe having a horizontally movable inlet defined by a wind sock pipe, a stream/water injection system disposed adjacent the inlet for charging a flowing stream of atmospheric sea air with finely distributed salt-free water, a drop separator for freeing the flowing air stream of water drops and a heater for reducing the relative humidity of the air stream prior to its entering a blower.

The advantage offered by this invention is that the changing conditions of the atmospheric air taken in from the immediate vicinity of the floating platform are rectified to conditions compatible for supplying a substantially salt-free, dry air to a blower located down stream of the intake for producing a trouble-free blower operation. The wind sock pipe allows for air to be taken in only from the leeward side where reduced foam formation is encountered. While in summer salt-free water may be injected for increasing the water content of the intake air, superheated steam/hot water may be introduced in winter to heat up the air and the air-borne water from temperatures below 0° C. to above 0° C. so as to avoid the risk of icing. The added water, even in the form of steam, causes all salt contained in the air to pass into the water for being retained in the drop separator together with the water. The injection of water or steam results in a good salt separation do to the increase water separation and the drop separator. The subsequent heating up of the air eliminates water drops from the air stream by vaporization and superheating of the water vapor.

BRIEF DESCRIPTION OF THE DRAWING

The above objectives and advantages of the invention will become manifest to those skilled in the art from reading the following detailed description of an embodiment of the invention when considered in the light of the attached drawing, in which.

DETAILED DESCRIPTION OF THE PREFERRED EMBODIMENT

Figure 1:
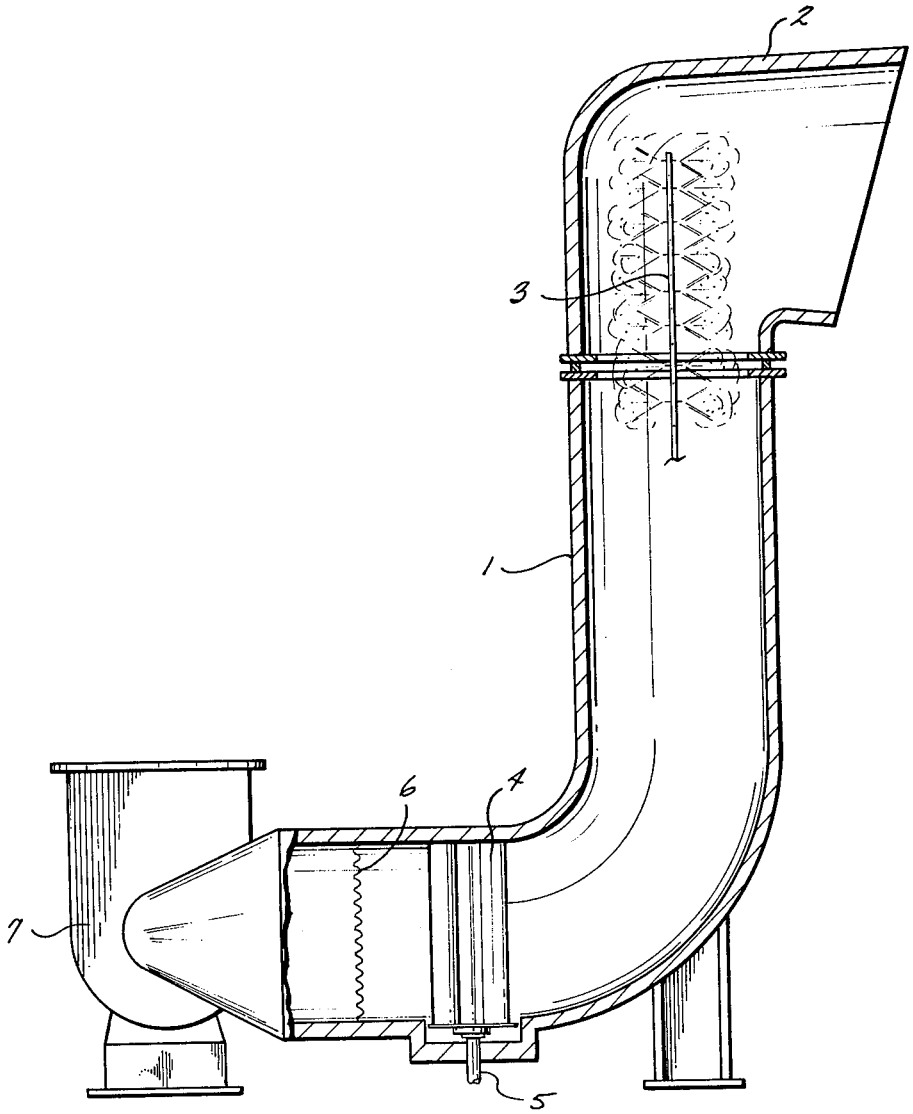
FIG. 1 is a section view of an apparatus for achieving the objectives of the invention.

Referring to FIG. 1, there is illustrated an air conditioning apparatus embodying the present invention. Briefly the apparatus includes a vertically disposed, angular suction pipe 1 having a horizontally movable wind sock pipe 2 affixed to the upper end of the pipe 1. A steam/water injection system 3 is disposed adjacent the inlet of the wind sock pipe 2 for charging the atmospheric air with salt-free water, hot water or steam. A drop separator 4 is disposed in the horizontal portion of the suction pipe 1 for removing the major portion of the water from the moving air stream. The removed water is evacuated from the separator 4 via a discharge line 5. A preheater 6 disposed between the drop separator 4 and a blower 7 reduces the relative humidity of the air prior to the air passing through the blower 7.

In operation, one hundred thousand $Nm^3/h$ of air is taken in through the inlet end of the suction pipe 1. Depending upon the atmospheric conditions, this air may be at 100% relative humidity, e.g. 15 g water (in droplets) per $Nm^3$ air and 0.6 g salt partly dissolved in water and partly dried out in the air. The horizontally movable wind sock pipe 2, the opening of which invariably turns towards the leeward side of the platform, permits taking in air substantially free from the whirled-up water, such as foam.

The steam/water injection system 3 allows for a heat and/or water supply as required for optimum conditioning of the intake air. In winter the air temperature must be increased so as to avoid icing in the suction pipe 1. Salt-free water injection and/or addition either in the form of desalinated water or in the form of steam is carried out in such a way as to guarantee that no free salt is present in the air, i.e. that the air is considerably over saturated. The air passing down through the suction pipe 1 flows through a drop separator 4. The water is evacuated from the drop separator by a line 5. The air still charged with residual humidity is subsequently heated in a preheater 6 to substantially reduce the relative humidity of the air with consequent super heating of the air-borne water vapor. The downstream blower 7 is, thus, not susceptible to being damaged by free water drops, salt incrustation, and/or icing. It may be expedient to insulate the entire suction pipe 1 in order to reduce heat losses by radiation.

The quantity of saliferous water to be discharged may be reduced by retreatment, recycling, and reinjection of part of the effluent water.

In accordance with the provisions of the patent statutes, the principle and mode of operation of the invention has been explained and what is considered to represent its preferred embodiment has been illustrated and described. It should, however, be understood that the invention may be practiced otherwise than as specifically illustrated and described without departing from the spirit and scope.

What we claim is:

1. A process for conditioning saliferous atmospheric intake air for use in floating chemical plants, comprising the steps a. circulating the inlet air through a closed conditioning zone to a drop separator and from the drop separator to the chemical plant;

b. charging a salt-free water spray into the circulating air before it reaches the drop separator to cause any salt particles contained in the intake air to pass into the sprayed water; and c. preheating the circulated air discharged from the drop separator, before it is circulated to the chemical plant, to reduce the relative humidity thereof, whereby a purified air which is free of salt and water drops is produced and circulated to the chemical plant.

2. The process defined in claim 1 wherein said salt-free water charged into the circulating air comprises steam.

3. The process defined in claim 1 wherein said salt-free water charged into the circulating air comprises hot water.

4. An apparatus for conditioning saliferous atmospheric intake air in floating chemical plants, comprising:

a. a suction pipe having air inlet and outlet ends and a horizontally-extending portion between the inlet and outlet ends;

b. a wind sock pipe affixed to the inlet end of said suction pipe and mounted for rotation by the wind so that an open inlet end thereof faces to leeward;

c. means disposed in said wind sock pipe for spraying water into air circulated therethrough;

d. a drop separator disposed in the horizontally extending portion of said suction pipe between the inlet and outlet ends thereof; and e. a preheater disposed in said suction pipe between said drop separator and the outlet end of said suction pipe whereby said apparatus can produce a purified, salt-free air which is also free of water drops.

5. Apparatus as claimed in claim 4 wherein said suction pipe has a vertically extending portion which extends from the horizontally extending portion to the inlet end thereof.

* * * * *